US005332353A

United States Patent [19]

Arnold

[11] Patent Number: 5,332,353

[45] Date of Patent: Jul. 26, 1994

[54] QUICK COUPLER FOR EXCAVATION EQUIPMENT

[75] Inventor: Carroll H. Arnold, Westminster, Mass.

[73] Assignee: Wain Roy, Inc., Hubbardston, Mass.

[21] Appl. No.: 18,028

[22] Filed: Feb. 16, 1993

[51] Int. Cl.[5] ..... E02F 3/28

[52] U.S. Cl. ..... 414/723; 37/468; 172/275; 403/322; 403/325

[58] Field of Search ..... 414/723, 686, 687, 694; 172/272-275; 37/347, 379, 264, 468; 403/322, 325

[56] References Cited

U.S. PATENT DOCUMENTS

| | | | |
|---|---|---|---|
| 3,231,116 | 1/1966 | Powell . | |
| 3,269,570 | 8/1966 | Wallberg . | |
| 3,767,070 | 10/1973 | Arnold . | |
| 3,854,608 | 12/1974 | Arnold . | |
| 3,876,091 | 4/1975 | MacDonald . | |
| 3,934,738 | 1/1976 | Arnold . | |
| 3,952,431 | 4/1976 | Gledhill et al. . | |
| 3,985,249 | 10/1976 | Aker et al. . | |
| 4,030,624 | 6/1977 | Matthews . | |
| 4,127,203 | 11/1978 | Arnold . | |
| 4,179,225 | 12/1979 | Asplund | 172/272 X |
| 4,214,840 | 7/1980 | Beales | 414/723 X |
| 4,311,428 | 1/1982 | Arnold . | |
| 4,345,872 | 8/1982 | Arnold . | |
| 4,397,604 | 8/1983 | McCain . | |
| 4,417,844 | 11/1983 | de Pingon . | |
| 4,436,477 | 3/1984 | Lenertz et al. . | |
| 4,726,731 | 2/1988 | Jones . | |
| 4,810,162 | 3/1989 | Foster . | |
| 4,871,292 | 10/1989 | Milanowski . | |
| 4,984,957 | 1/1991 | Noguchi et al. . | |
| 5,082,389 | 1/1992 | Balemi | 414/723 X |

OTHER PUBLICATIONS

O.E.M. Bucket Couplers (J.R.B. Pat. No. 4,726,731) Brochure Copy.

Adjust-Bucket (Pat. No. 3,231,116) Brochure Copy.

Hendrix Brochure Copy.

Central Fabricators Brochure Copy.

*Primary Examiner*—Donald W. Underwood

*Attorney, Agent, or Firm*—Fish & Richardson

[57] ABSTRACT

An improved quick coupler for attaching a tool to an excavator includes a body of a pair of spaced parallel plates providing structure for fixed attachment of the coupler to an end of the excavator. The plates define a first slot with an opening facing in a first direction to engage upon a first tool and a second slot with an opening facing in a second direction to engage a parallel second tool pin upon the tool. The body has a third plate between the spaced parallel plates. The coupler has a latch for securing the second pin in the second slot, the latch including a coupler gate rotatably mounted on an axis transverse to the second pin axis to pivot about the axis between a first position with the pin secured in the second slot by the gate and a second position with the gate clear of the second slot. A latch lever rotatably mounted on the coupler gate has a handle for moving the lever and a tab for engaging a third slot in the third plate. The latch lever pivots between a first position with the tab engaged in the third slot to resist rotation of the gate and a second position with the tab clear of the slot to allow rotation of the gate.

7 Claims, 9 Drawing Sheets

QUICK COUPLER FOR EXCAVATION EQUIPMENT

BACKGROUND OF THE INVENTION

This invention relates to couplers for attaching excavator buckets and other tools to heavy construction equipment.

Quick couplers have been widely used with excavating equipment, e.g. hydraulic excavators (backhoes), to allow an individual piece of equipment to be used with a variety of tools, e.g., different buckets, grapples and the like, without extended downtime for changing tools. Conventional quick couplers are described in, e.g., U.S. Pat. Nos. 4,726,731 and 3,231,116. Quick couplers typically consist of a pair of spaced parallel plates, the plates defining holes for fixed attachment of the coupler to the end of a backhoe. The plates also define a first slot facing generally forward to engage a first pin on the bucket or tool, and a second slot, facing generally downward (disposed at 90° to the first slot) to engage a second pin on the bucket or tool. In operation, the first pin is engaged in the first slot. The coupler is then rotated about the longitudinal axis of the first pin to engage the second pin in the second slot. The coupler and tool are thereafter secured together by engagement of a coupler gate with the second pin. This coupler gate is typically pivotally mounted to a pin on the coupler such that it pivots about a horizontal axis parallel to the longitudinal axes of the first and second slots/pins. These conventional couplers can be rendered virtually unusable by a relatively small degree of wear in the slots.

SUMMARY OF THE INVENTION

The present invention provides an improved quick coupler, the latch of which closes by rotation about a vertical, rather than horizontal axis. The latch of the invention may be easily shimmed to accommodate wear, and thus the coupler can be used over longer periods of time without downtime for repair, as compared to conventional quick couplers. The latch of the invention is also provided with a fastening system which ensures that the latch will remain closed while the tool is in use.

In one aspect, the invention features a quick coupler for mounting a tool to an excavator. The quick coupler includes a coupler body comprising a pair of spaced parallel plates, the plates providing means for fixed attachment to an end of the excavator. The plates define a first slot having an opening facing in a first direction and adapted to engage a first pin on the tool, and a second slot, having an opening facing in a second direction and adapted to engage a second pin on the tool, the first pin and the second pin lying substantially parallel to each other. The body further includes a third plate, mounted between and substantially perpendicular to the spaced parallel plates. The coupler further includes a latch mechanism for securing the second pin in the second slot, the latch mechanism including a coupler gate, rotatably mounted on an axis transverse to the longitudinal axis of the second pin, so that the gate pivots about the transverse axis between a first position in which the second pin is secured in the second slot by the gate, and a second position in which the gate is clear of the second slot, and a latch lever, mounted upon the coupler gate, comprising a tab portion for engaging a third slot defined by said third plate. The latch lever preferably also includes a handle portion, for moving the lever to effect manual actuation of the latch mechanism. The latch lever is rotatably mounted such that it pivots between a first position, in which the tab engages the third slot, in a manner to resist rotation of the coupler gate, and a second position in which the tab is clear of the slot, thereby to allow rotation of the coupler gate.

In preferred embodiments, the latch mechanism further includes means for resisting rotation of the latch lever when the latch lever is in the first position, preferably a linchpin which is received by an aperture in the coupler body located so that the linchpin extends out of the aperture adjacent an upper surface of the handle portion of the latch lever. Alternatively or additionally, the means for resisting rotation may comprise means for biasing the tab portion of the latch lever against a front surface defining the third slot, causing the latch lever to further resist rotation from its first to its second position. Preferably, the latch lever is rotatably mounted on a shaft, and the biasing means comprises a coil spring surrounding said shaft between the coupler gate and the latch lever.

In other preferred embodiments, the latch assembly includes means for accommodating wear on the surfaces of the coupler gate which engage the second pin. Preferably, the coupler gate is mounted on the third plate, and there is a space between the coupler gate and the third plate, to allow shim material to be inserted therebetween to accommodate wear of the surface of the coupler gate which covers the opening of the second slot, and the latch lever is rotatably mounted on a shaft, and there is a space between the shaft and the coupler gate to allow shim material to be inserted therebetween to accommodate wear of the surface of the coupler gate which is substantially parallel to a wall of the second slot.

Advantageously, unlike conventional coupling devices which typically require the use of bolts, wrenches and other tools, operation of the coupler requires no additional tools.

Other features and advantages of the invention will be apparent from the following description of a presently preferred embodiment, and from the claims.

DESCRIPTION OF THE PREFERRED EMBODIMENTS

Figure 1:
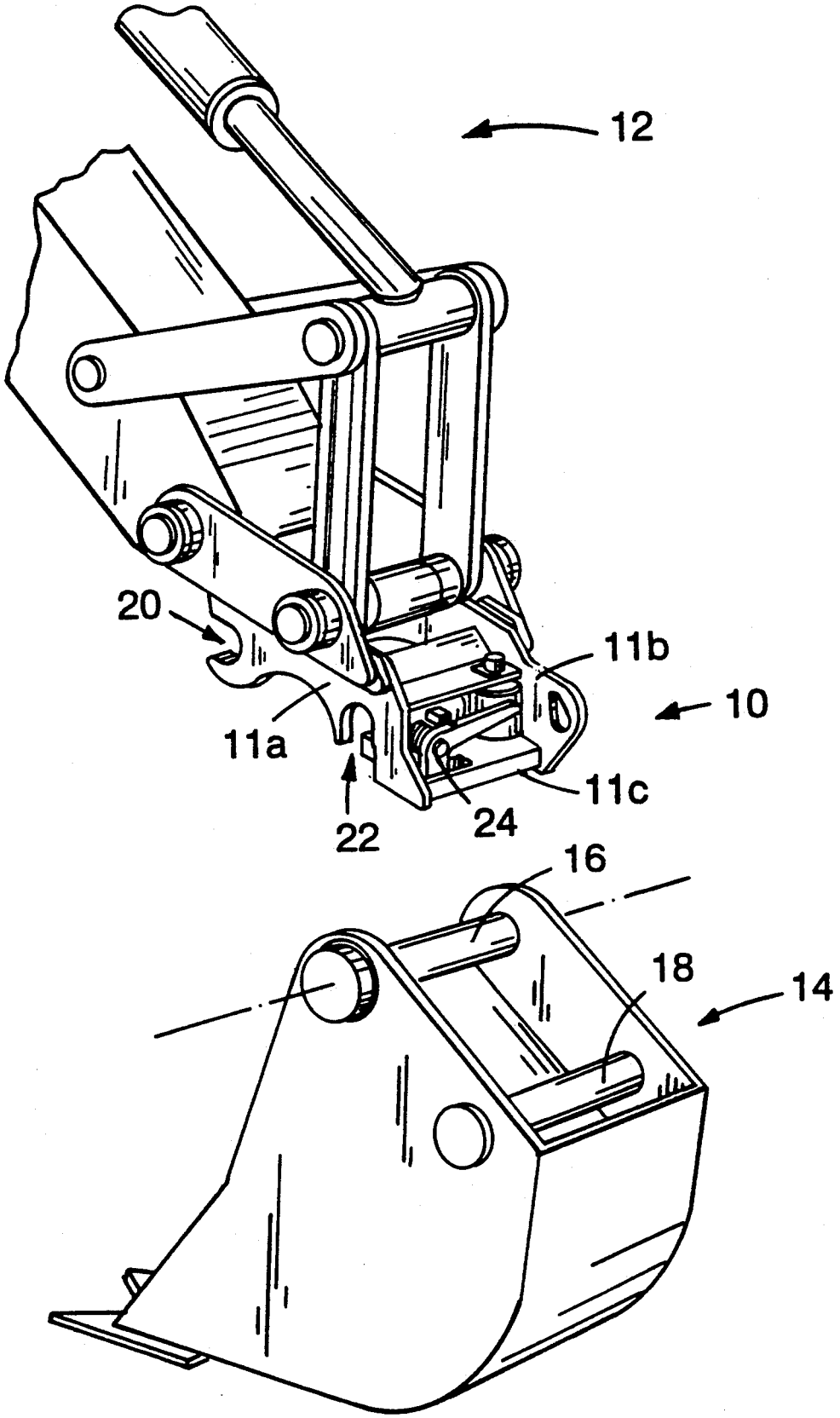
FIG. 1 is a perspective view of a bucket and a backhoe arm with an improved quick coupler according to one embodiment of the invention.

Referring to FIG. 1, an improved quick coupler 10 of the invention is attached to the arm 12 of a backhoe (not shown). Quick coupler 10 is pinned onto arm 12, e.g., through apertures 12 (shown in FIGS. 2–5*a*), or mounted in any other conventional manner. The quick coupler 10 includes a pair of spaced parallel plates 11*a*, 11*b*, and a third plate 11*c*. Bucket 14 has a first pin 16 and a second pin 18, which are engaged, respectively, by first slot 20 and second slot 22 of quick coupler 10. The second pin 18 is secured in engagement within the second slot 22 by latch assembly 24.

Figure 2:
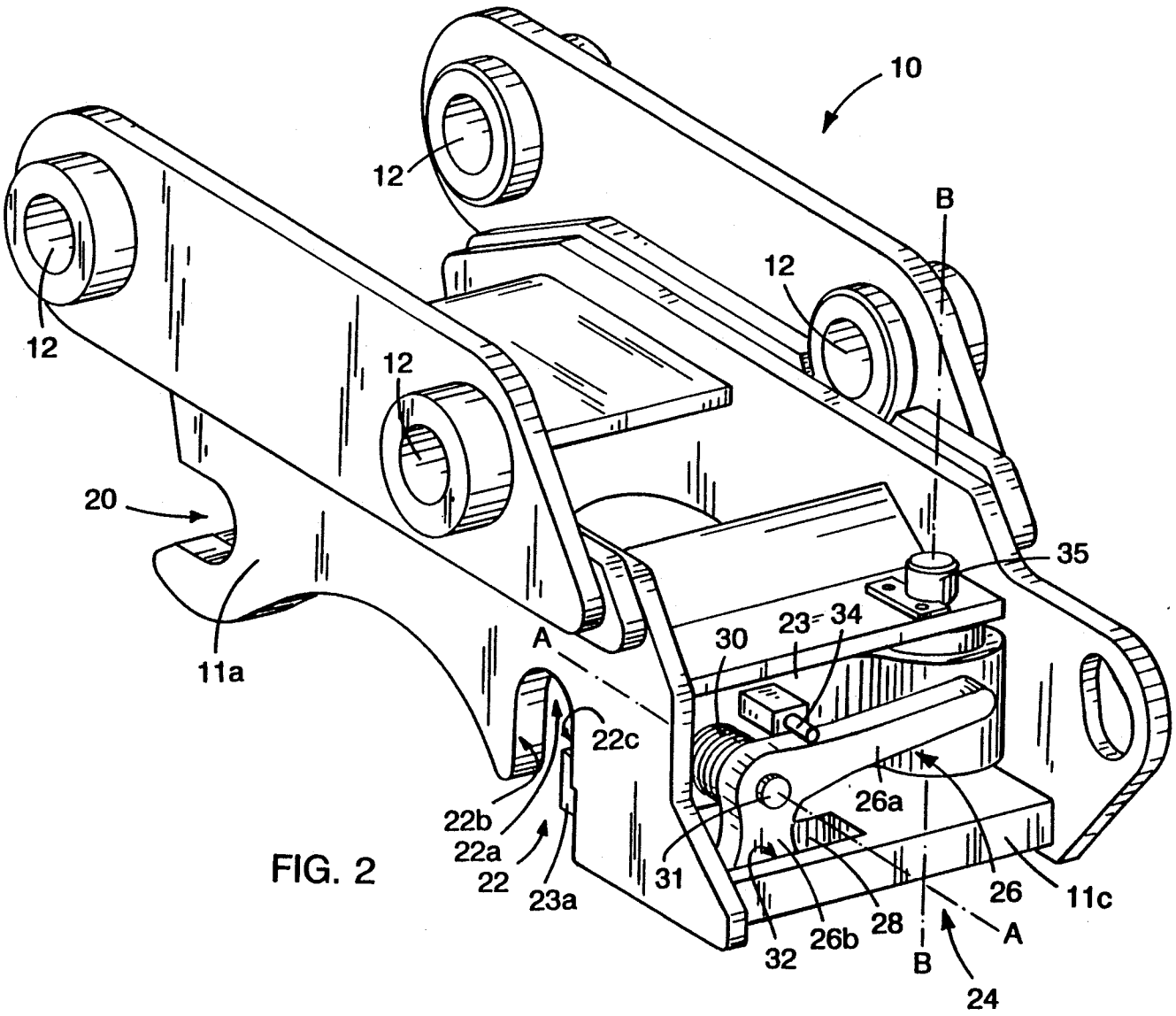
FIG. 2 is a perspective view of an improved quick coupler according to one embodiment of the invention, taken from the latch end.
Figure 2A:
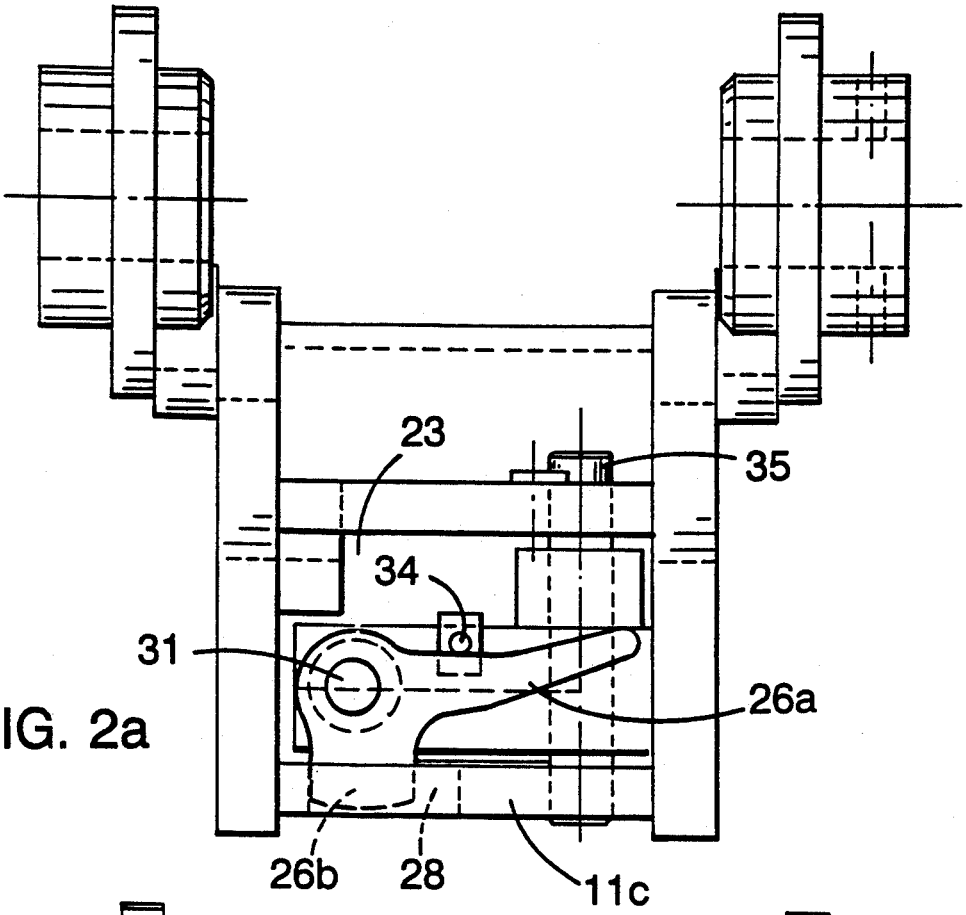
FIG. 2*a* is a front plan view and FIG. 2*b* is a top plan view, respectively, of the improved quick coupler of FIG. 2.
Figure 3A:
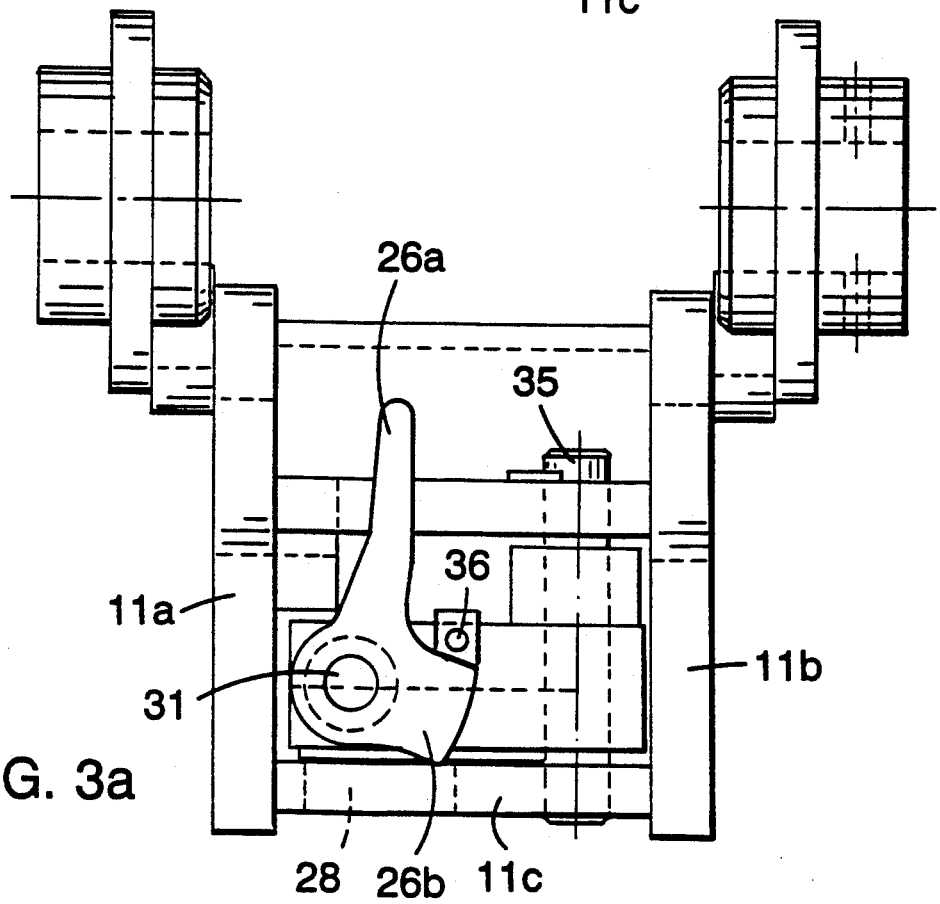
FIG. 3*a* is a front plan view and FIG. 3*b* a top plan view, respectively, of the improved quick coupler of the invention with the latch in open position.
Figure 2B:
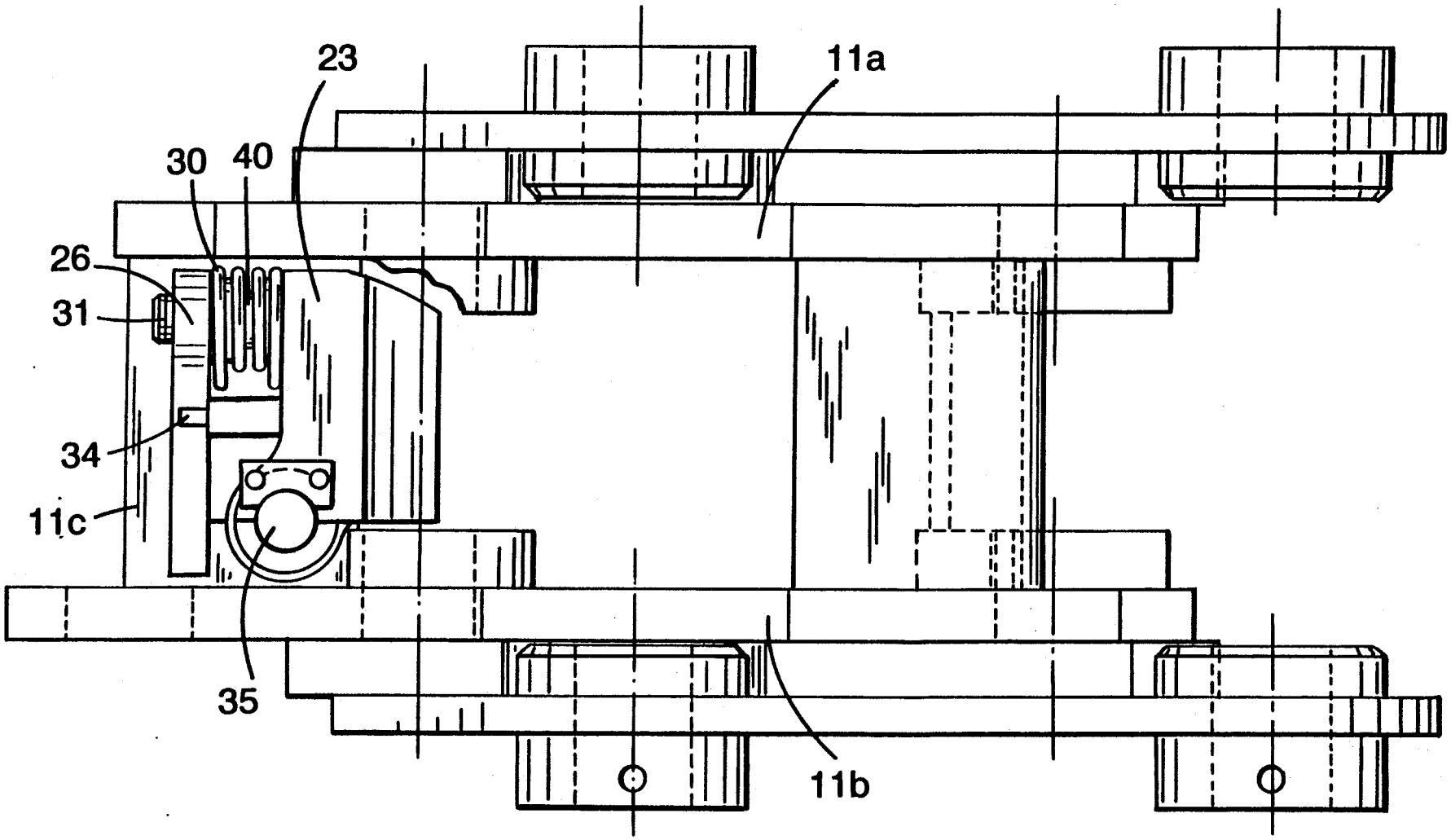

Referring now to FIGS. 2–2*b* and 3–3*b*, operation of latch assembly 24 will be described. In FIGS. 2, 2*a* and 2*b*, latch assembly 24 is in closed position, with the coupler gate 23 securing second pin 18 in engagement within second slot 22 by blocking the opening of slot 22 (see FIG. 5*a*). When the latch assembly is closed, handle portion 26*a* of latch lever 26 extends horizontally, such that tab portion 26*b* of latch lever 26 extends downward, engaging latch opening 28 in third plate 11*c*. This engagement of the latch lever within the latch opening in the fixed third plate 11*c* prevents the latch assembly from opening, i.e., prevents the coupler gate from rotating about its axis to a position in which the coupler gate does not block the opening of slot 22. The latch assembly is secured in this closed position by safety spring 30, which biases the latch lever forward, so that tab portion 26*b* is urged against front wall 32 of opening 28, causing the latch lever to resist rotation about shaft 31 on which it is rotatably mounted. Further security is provided by over-center linchpin 34 inserted into an aperture 36 (FIG. 3*a*) in coupler gate 23, aperture 36 being located such that linchpin 34 extends above handle portion 26*a* of latch lever 26 when latch lever 26 is in its closed position, to resist upward movement of handle portion 26*a*.

Figure 3:
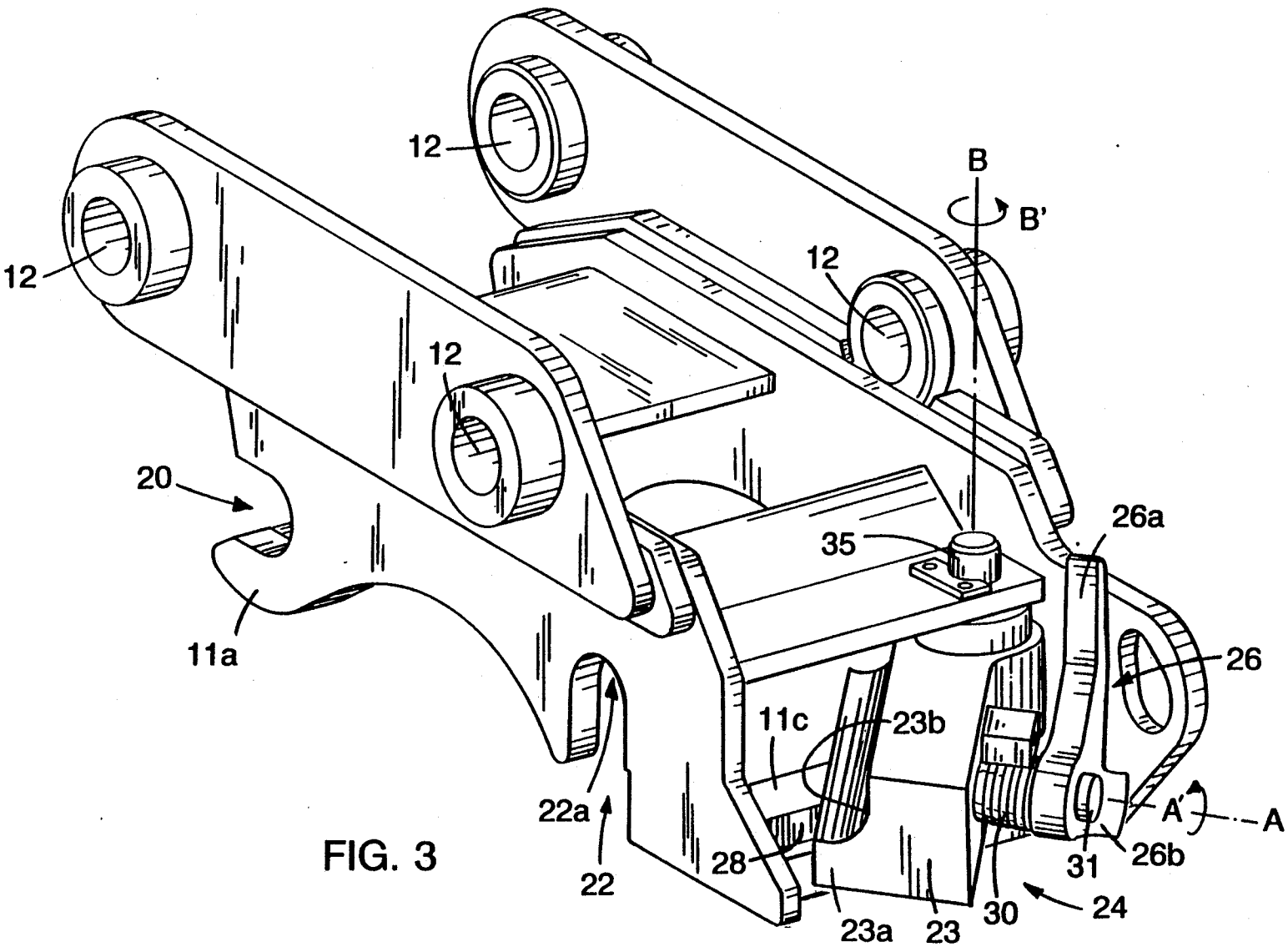
FIG. 3 is a perspective view of the improved quick coupler of FIG. 2, taken from the latch end, with the latch in an open position.
Figure 3B:
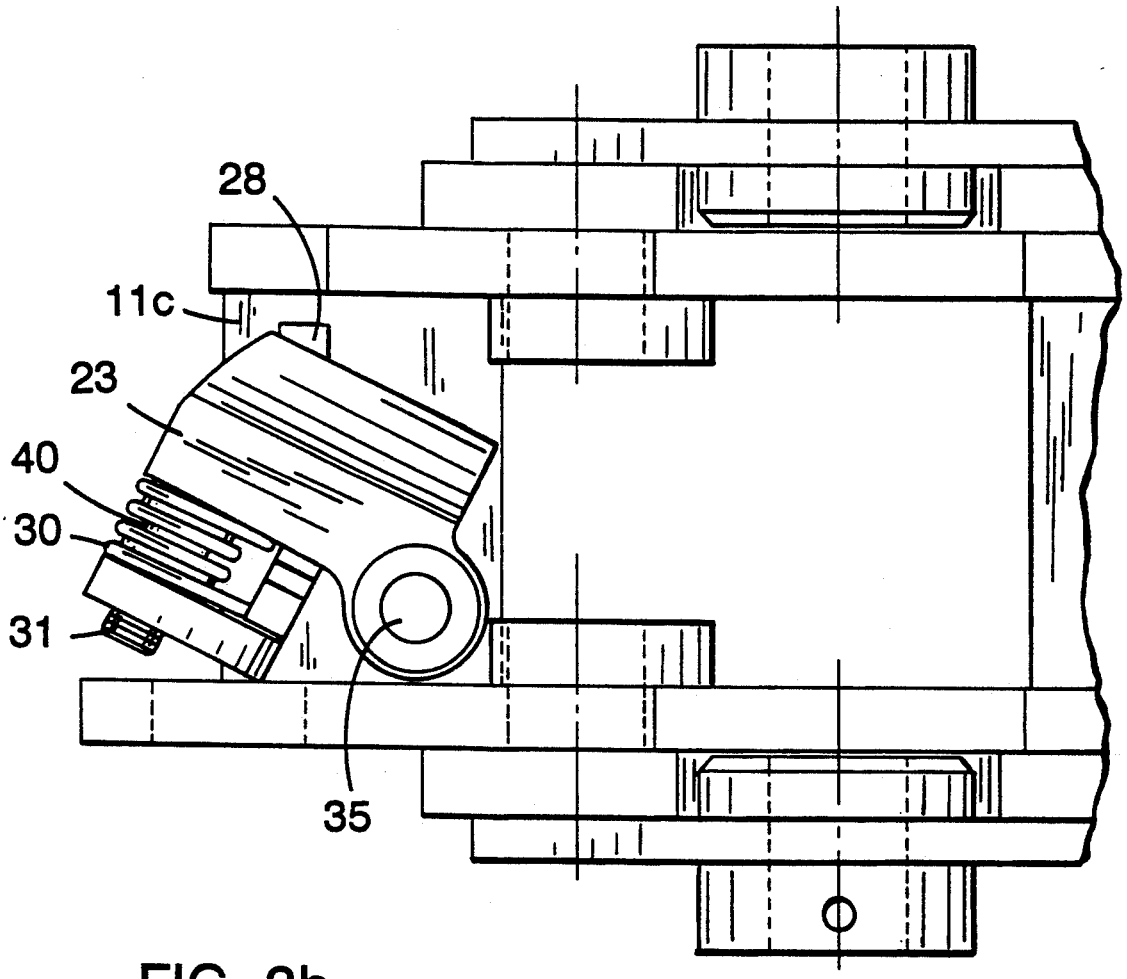
Figure 4:
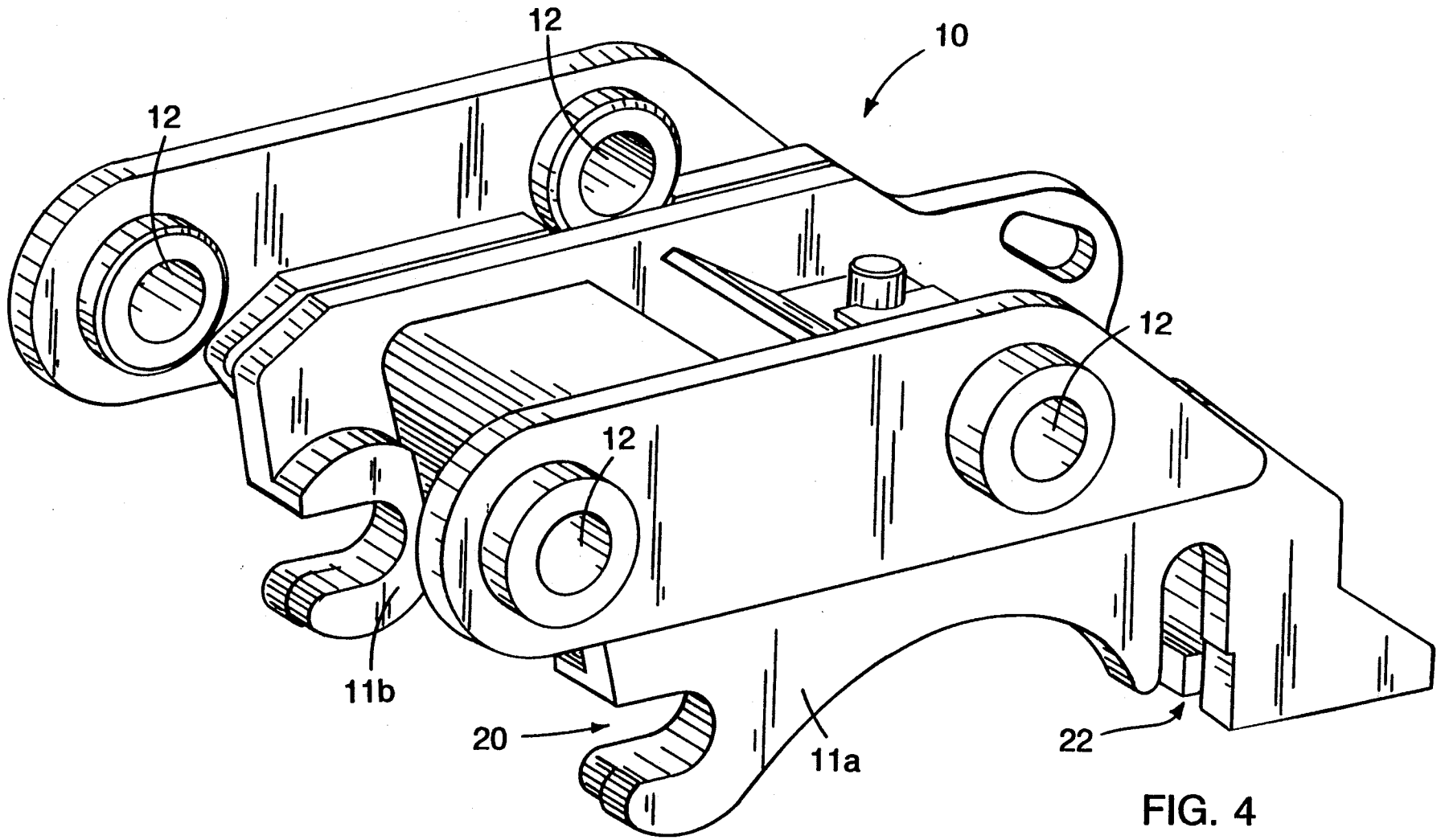
FIG. 4 is a perspective view of the improved quick coupler of FIG. 2, taken from the opposite end.
Figure 5:
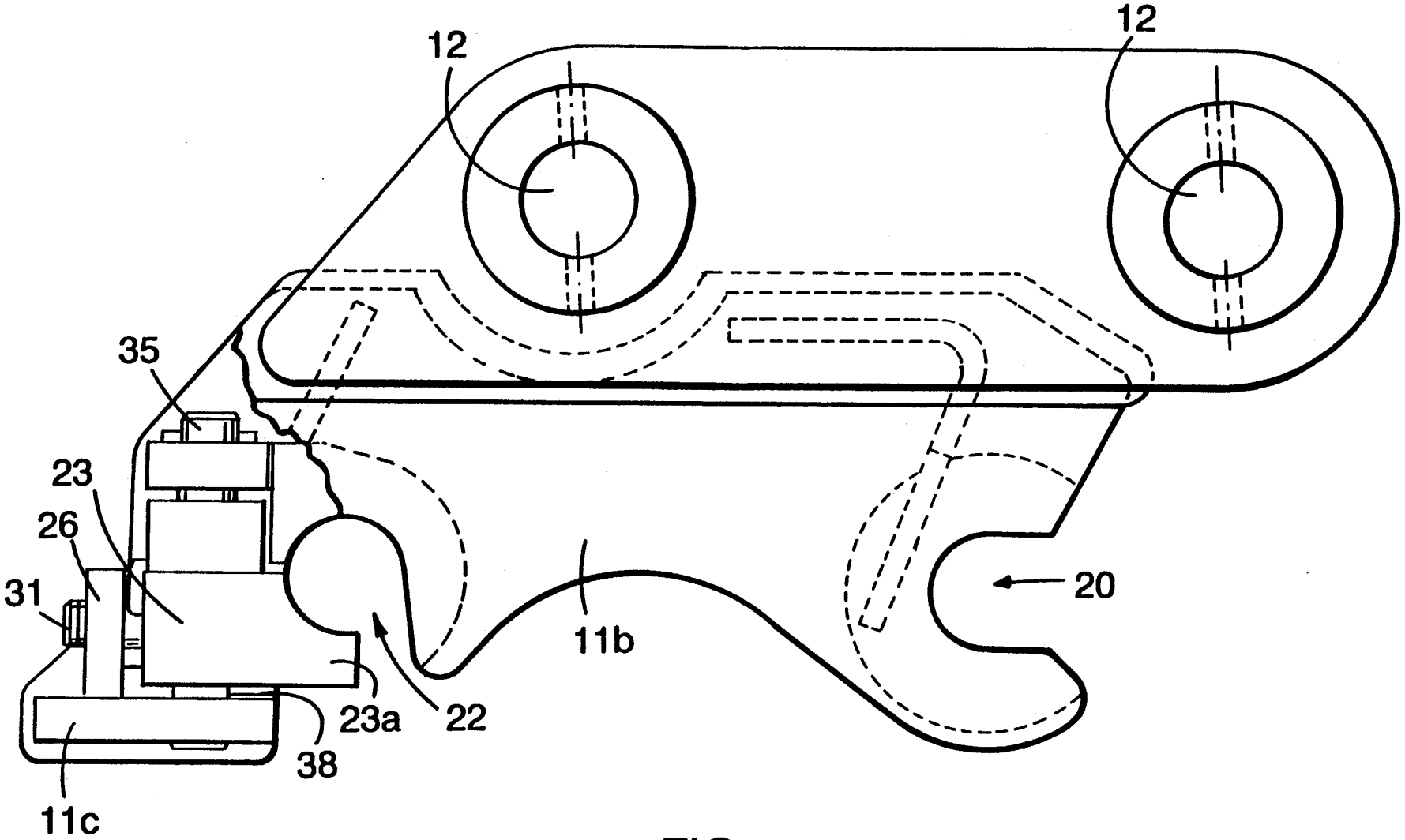
FIG. 5 is a side plan view of the improved quick coupler of FIG. 2.
Figure 5A:
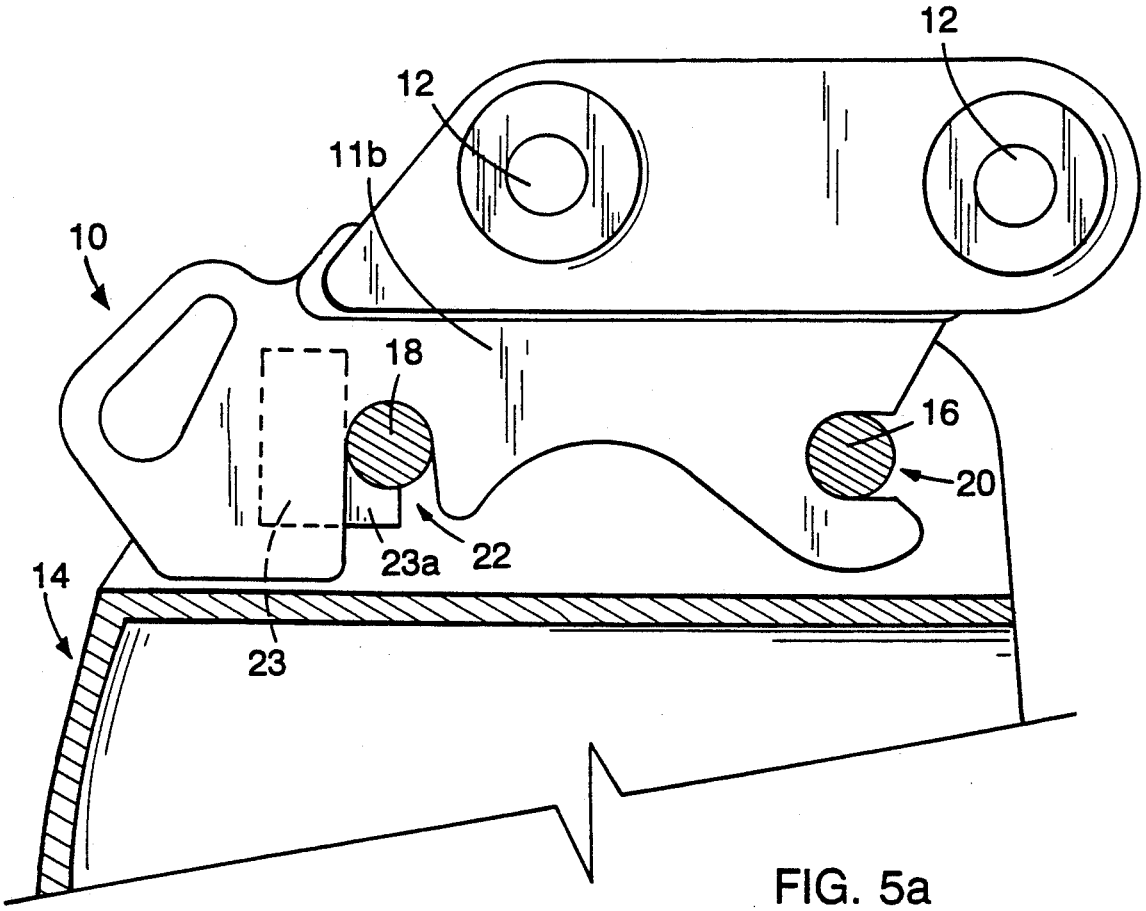
FIG. 5*a* is a partial side view of the improved quick coupler of the invention attached to a bucket.

To move latch assembly 24 to its open position, shown in FIGS. 3–3*b*, linchpin 34 is first removed from aperture 36, allowing handle portion 26*a* of latch lever 26 to be raised. To raise portion 26*a*, latch lever 26 is rotated on shaft 31 about horizontal axis A, in the direction indicated by arrow A′ (FIG. 3), to release tab portion 26*b* from opening 28. The entire latch assembly is rotated rearwardly (towards the user) about vertical shaft 35, on which coupler gate 23 is mounted, so that the coupler gate pivots about vertical axis B in the direction indicated by arrow B′. In this manner, portion 23*a* of coupler gate 23 moves from the position in which it blocked the opening of slot 22 (FIGS. 2, 5*a*) to a second position (FIG. 3) in which it is clear of the opening of slot 22, allowing pin 18 to be released.

For optimal safety and efficient operation, it is desired that pin 18 tightly engage slot 22 when latch assembly 24 is closed. Movement of the pin within the slot during use increases wear, and makes the tool difficult and eventually impossible to use. Accordingly, in an improved quick coupler of the invention, a space is provided in the coupler so that, as wear occurs during extended use of the coupler, shim stock (or a wedge) may be inserted in order to tighten the engagement of the pin in the slot by the coupler gate.

To accommodate wear of portion 23*a* of the coupler gate 23, and/or surface 22*a* of slot 22, shim space 38 is provided (see FIG. 5) below the lower surface of portion 23*a*. By placing shim stock in shim space 38, coupler gate 23 can be moved upward, along axis B, so that portion 23*a* grips pin 18 securely in the vertical direction.

To accommodate wear of the surfaces 22*b*, 22*c* of slot 22 and surface 23*b* of coupler gate 23, shim space 40 is provided on shaft 31 between the face of the latch lever and the face of the coupler gate (see FIG. 2*b*). Placing shim stock in shim space 40 urges surface 23*b* towards pin 18, providing a tighter fit between the coupler gate and pin in the horizontal direction.

The coupler of the invention provides significant improvements over conventional coupler devices. The self-contained latch mechanism eliminates the need for other loose tools, e.g., wrenches or bolts. Further, the provision of shim spaces allows accommodation for wear without looseness or chatter.

Other embodiments are within the claims. For example, rather than having the latch mechanism manually actuated, the latch mechanism may be actuated by remote control, e.g., from the cab of the excavator, using hydraulic or pneumatic cylinders to move the latch lever. As another example, in addition to the coupler shown, the latch mechanism of the invention is suited for use in many other types of couplers, e.g., swinger couplers such as those sold by Wain Roy, Inc., Hubbardston, Massachusetts, under the tradename "Piggy Back Swinger".

I claim:

1. A quick coupler for attaching a tool to an excavator comprising:

a coupler body comprising a pair of spaced parallel plates, said plates defining means for fixed attachment of said quick coupler at the end of the excavator, said plates defining a first slot facing in a first direction, said first slot adapted for engagement upon a first pin on the tool, and a second slot facing in a second direction, said second slot adapted for engagement upon a second pin on the tool, the first pin and the second pin being substantially parallel, and a third plate, mounted between and substantially perpendicular to said pair of spaced parallel plates; and a latch mechanisms mounted to said coupler body for securing engagement of said second slot upon the second pin, said latch mechanism comprising a coupler gate rotatably mounted on an axis transverse to a longitudinal axis of the second pin, so that the gate pivots about said transverse axis between a first position in which engagement of said second slot upon the second pin is secured by said gate, and a second position in which said gate is clear of said second slot; and a latch lever mounted upon said coupler gate, said latch lever comprising a tab portion for engaging in a third slot defined by said third plate, said latch lever being rotatably mounted to pivot between a first position, in which said tab engages in said third slot, in a manner to resist rotation of said coupler gate, and a second position in which said tab is clear of said slot, thereby to allow rotation of said coupler gate.

2. A quick coupler of claim 1 wherein said latch mechanism further comprises means for resisting rotation of said latch lever when said latch lever is in said first position, said means comprising a linchpin received by an aperture defined in the gate.

3. A quick coupler of claim 1 wherein said latch lever further comprises a handle portion for moving said lever.

4. A quick coupler of claim 3 wherein said latch mechanism further comprises means for resisting rotation of said latch lever when said latch lever is in said first position, said means comprising a linchpin received by an aperture defined in the gate, said aperture being located so that said linchpin extends from said aperture adjacent an upper surface of said handle portion of said latch lever when said latch lever is in said first position.

5. A quick coupler of claim 2 wherein said latch lever is rotatably mounted on a shaft, and said means for resisting rotation further comprises means for biasing said tab portion of said latch lever against a front surface of said third slot, said means for biasing comprises a coil spring surrounding said shaft between said coupler gate and said latch lever.

6. A quick coupler of claim 1 wherein said coupler gate is mounted on said third plate, and said latch assembly includes means comprising shim material for accommodating wear on surfaces of said coupler gate in engagement with the second pin, there being a space between said coupler gate and said third plate for receiving said shim material therebetween for accommodation of wear of a surface of said coupler gate covering an opening of said second slot.

7. A quick coupler of claim 6 wherein said latch lever is rotatably mounted on a shaft, and a space is defined between said shaft and said coupler gate for receiving said shim material therebetween for accommodation of wear of a surface of said coupler gate, said surface lying substantially parallel to a wall of said second slot.

* * * * *